US011723137B2

(12) United States Patent
Lee et al.

(10) Patent No.: US 11,723,137 B2
(45) Date of Patent: Aug. 8, 2023

(54) LIGHT DEVICE CONTROL CIRCUIT

(71) Applicant: ESUSE AUTO PARTS MANUFACTURING CO., LTD., New Taipei (TW)

(72) Inventors: Ting-Fang Lee, New Taipei (TW); Wen-Chung Han, New Taipei (TW)

(73) Assignee: ESUSE AUTO PARTS MANUFACTURING CO., LTD., New Taipei (TW)

( * ) Notice: Subject to any disclaimer, the term of this patent is extended or adjusted under 35 U.S.C. 154(b) by 0 days.

(21) Appl. No.: 17/695,431

(22) Filed: Mar. 15, 2022

(65) Prior Publication Data

US 2022/0272819 A1 Aug. 25, 2022

Related U.S. Application Data

(63) Continuation-in-part of application No. 17/345,765, filed on Jun. 11, 2021, now Pat. No. 11,452,191.

(30) Foreign Application Priority Data

Feb. 25, 2021 (TW) ..... 110106770

(51) Int. Cl.
*H05B 47/16* (2020.01)

(52) U.S. Cl.
CPC ..... *H05B 47/16* (2020.01)

(58) Field of Classification Search
CPC ..... H05B 45/10; H05B 47/10; H05B 47/16; H05B 47/155; H05B 47/165
See application file for complete search history.

(56) References Cited

U.S. PATENT DOCUMENTS

2014/0239807 A1* 8/2014 Hammock ..... B60Q 1/445 315/77
2020/0029642 A1 1/2020 Kinney

* cited by examiner

*Primary Examiner* — Jimmy T Vu
(74) *Attorney, Agent, or Firm* — Muncy, Geissler, Olds & Lowe, P.C.

(57) ABSTRACT

Light device control circuit includes signal processor; control circuit including control signal source and active switch, active switch having output end thereof electrically connected to control input side of the signal processor through control bus; data synchronization circuit including data signal source and another set of active switches, and the output end of the another set of active switches being electrically connected to data input side of signal processor through data bus, signal processor forming electrical connection with signal connection circuit by data output side to form signal and command synchronization between data input side and data output side; and warning light control IC connected to warning lights and forming electrical connection with data bus outside data output side, and transmitting data, clock pulse and ID information from data output side, so that the starter and the receivers select one of the flash modes to flash the light.

10 Claims, 5 Drawing Sheets

LIGHT DEVICE CONTROL CIRCUIT

This application is a Continuation-In-Part of application Ser. No. 17/345,765, filed on Jun. 11, 2021, for which priority is claimed under 35 U.S.C. § 120, the entire contents of which are hereby incorporated by reference.

This application claims the priority benefit of Taiwan patent application number 110106770, filed on Feb. 25, 2021.

BACKGROUND OF THE INVENTION

1. Field of the Invention

The present invention provides a light device control circuit, especially a control circuit structure so configured that each warning light has its ID Number, and the Starter transmits data, clock and identity signals through the Data Bus to control a plurality of Receivers, thereby improving the warning light control stability and flicker coordination.

2. Description of the Related Art

Warning lights are used in many environments and places, such as road construction warnings, public places safety warnings, high-rise building safety warnings, fire trucks, ambulances and police vehicles, etc. The warning light can be divided into a single warning light or a light device composed of plural warning lights. The Light Device is mostly installed on the roof of the aforementioned vehicle that needs to be warned. The conventional light device needs to add an electronic control device to control multiple warning lights to achieve the warning effect of coordinating the flashing of multiple warning lights. At present, the appearance and flashing effects of all warning lights on the market are almost the same. However, the flashing effect of multiple warning lights controlled by an electronic control device is not very coordinated, and it also causes the warning effect to be poor. In addition, the additional electronic control device in the market light device also increases the manufacturing cost, and the sales price of the light device terminal also increases, which is not conducive to the price competitiveness in the sales market. Therefore, how to try to solve the above-mentioned deficiencies and inconveniences of prior art light device is the direction that relevant industries urgently want to study and improve.

SUMMARY OF THE INVENTION

The present invention has been accomplished under the circumstances in view. It is therefore the main object of the present invention to provide a light device control circuit, which comprises a signal processor; a control circuit comprising a control signal source and an active switch, the active switch having the output end thereof electrically connected to a control input side of the signal processor through a control bus; a data synchronization circuit comprising a data signal source and another set of active switches, and the output end of the another set of active switches being electrically connected to a data input side of the signal processor through the data bus, the signal processor forming an electrical connection with a signal connection circuit by a data output side to form signal and command synchronization between the data input side and the data output side; and a warning light control IC connected to a plurality of warning lights and forming an electrical connection with the data bus outside the data output side, and transmitting a data, a clock pulse and an ID information from the data output side, so that the starter and the receivers select one of the flash modes to flash the light. Through the aforementioned control circuit structure, each warning light is set to have its ID Number, and the Starter transmits data, clock and identity signals through the Data Bus to control multiple Receivers, which can improve the warning light control stability and flicker coordination.

Preferably, the active switches are composed of an N-Channel E-MOSFET, and the N-Channel E-MOSFET comprises a Zener diode connected between the source and drain thereof to prevent electrostatic discharge.

Preferably, a current limiter and two resistors are connected in series between the control signal source and each active switch. The floating terminals of the series connection of the two resistors are connected to a ground point. The first node between the two resistors forms an electrical connection with the gate of the associating active switch. The source of the associating active switch is connected to the ground point. The drain of the associating active switch is connected to the control input side of the signal processor. The current limiter is composed of a diode.

Preferably, a second node is formed between the data signal source and the another set of active switches. The second node has the first side thereof connected to an input voltage source, a current limiter and a resistor, and the second side thereof connected in series with another current limiter and another two resistors. The another set of active switches is composed of a first stage active switch and a second stage active switch. The floating terminals of the series connection of the said another two resistors are connected to a ground point. A third node is formed between the said another two resistors to form an electrical connection with the gate of the second stage active switch. The source of the first stage active switch and the source of the second stage active switch are connected to the ground point. The drain of the second stage active switch is connected to the data bus and the data input side of the signal processor. The current limiter and the other current limiter are respectively composed of a diode.

Preferably, the signal connection circuit comprises a signal processor power supply and a first resistor and a second resistor connected in series. The floating terminal of the first resistor is connected to the signal processor power supply. A fourth node electrically connected to the data bus outside the data output side is formed between the first resistor and the second resistor. The second resistor is electrically connected to the gate of an active switch, which has the source thereof connected to a ground point and the drain thereof connected to the other resistor. The floating terminal of the other resistor is electrically connected between the data signal source and the said another set of active switches through a synchronization connection line.

Preferably, between the data bus outside the data output side and the warning light control IC, a signal processor power supply and first, second and third resistors are connected in series in sequence. The floating terminal of the first resistor is connected to the signal processor power supply. A fifth node electrically connected to the data bus is formed between the first resistor and the second resistor. A sixth node electrically connected to the enable pin of the warning light control IC is formed between the second resistor and the third resistor. The floating terminal of the third resistor is connected to a ground point.

DETAILED DESCRIPTION OF THE PREFERRED EMBODIMENT

Figure 1:
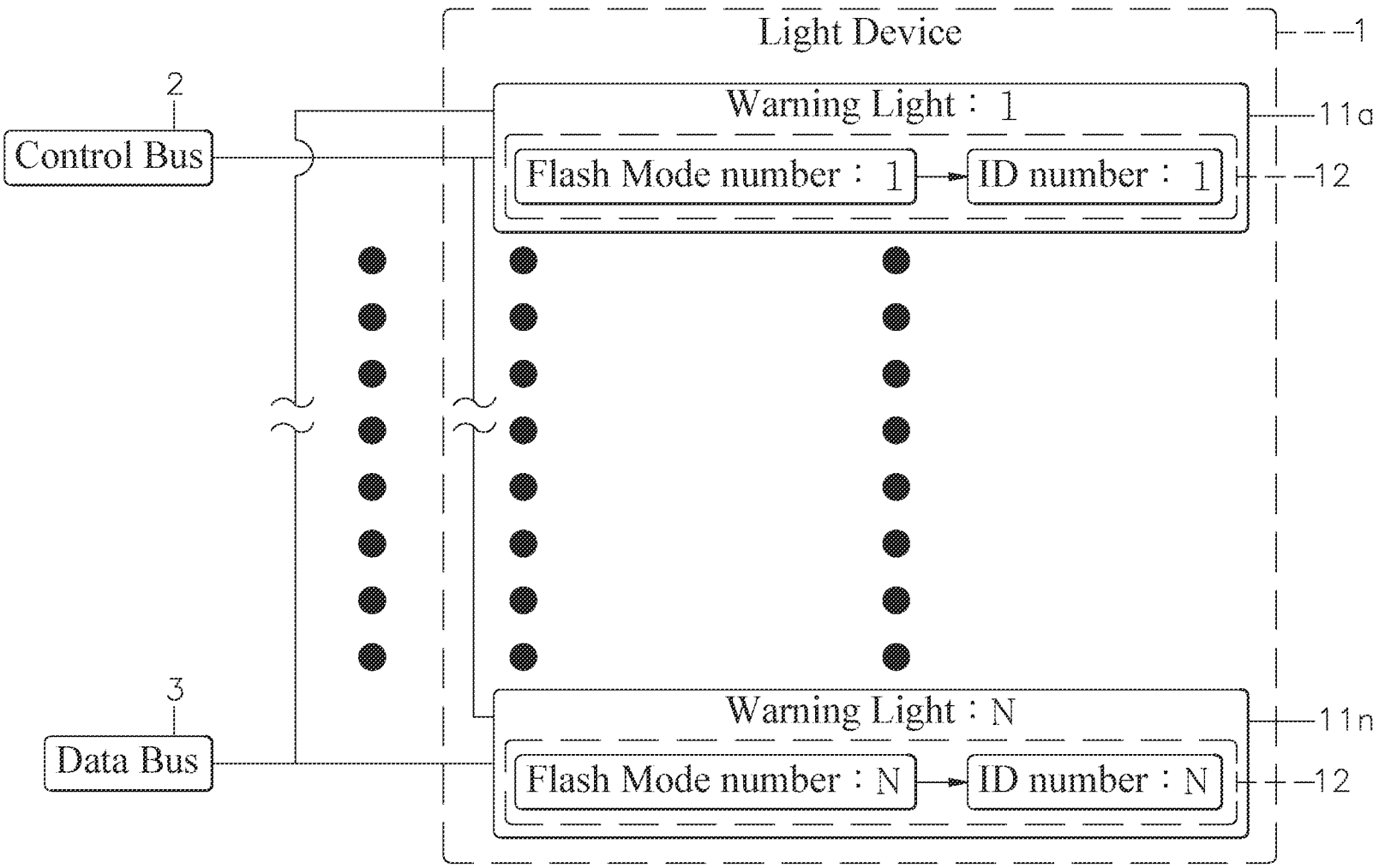
FIG. 1 is a function block diagram of a light device and its control architecture according to the present invention.
Figure 2:
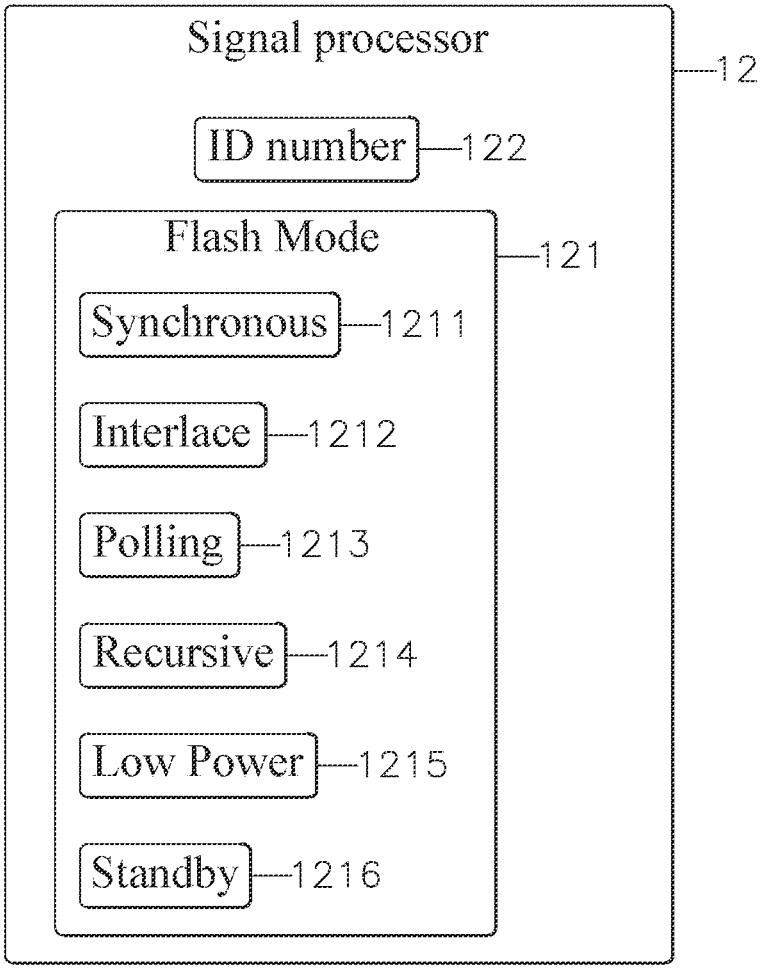
FIG. 2 is a function block diagram of the data stored in the signal processor of the present invention.
Figure 3:
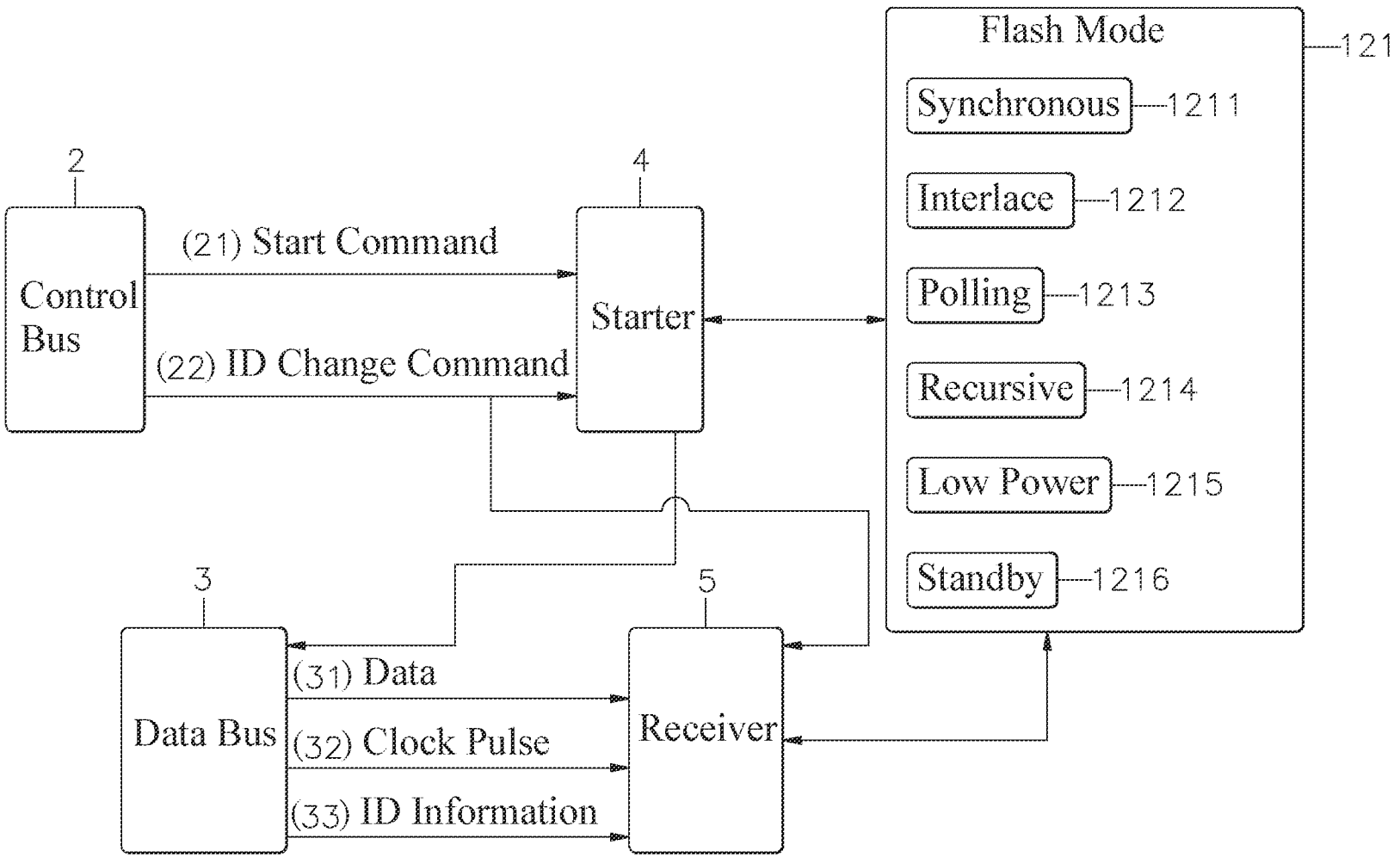
FIG. 3 is another function block diagram of the light device and its control architecture according to the present invention.

Referring to FIGS. 1-3, the light device control architecture of the present invention comprises a Light Device 1, a Control Bus 2 and a Data Bus 3. Its main component and features are detailed as follows:

Referring to FIG. 1, the Light Device 1 comprises a plurality of warning lights (11*a*~11*n*), and each of these warning lights (11*a*~11*n*) is electrically connected to the Control Bus 2 and the Data Bus 3 through a cable. These warning lights (11*a*~11*n*) further include a signal processor 12, and the signal processor 12 is composed of a Micro Control Unit (MCU) or a Central Processing Unit (CPU).

Referring to FIG. 2, the signal processor 12 of each of the warning lights (11*a*~11*n*) has stored therein a Flash Mode 121 and an ID Number 122. The Flash Mode 121 includes Synchronous 1211, Interlace 1212, Polling 1213, Recursive 1214, Low Power 1215 and Standby 1216. In addition to the aforementioned Flash Mode 121, a Starter 4 can also use the Data Bus 3 to control multiple Receivers to flash in different modes (for example: the first Receiver is to do Synchronous, the second Receiver is to do Polling, and the third Receiver is to do Interlace). The aforementioned control of the flashing of the multiple Receivers 5 by the Starter 4 is also within the protection scope of the present invention. The ID Number 122 is determined by the Control Bus 2's Start Command 21 and ID Change Command 22. Therefore, the ID Numbers 122 of the warning lights (11*a*~11*n*) are in a floating state, but they can only be changed when the Start Command 21 and the ID Change Command 22 are received.

Referring to FIG. 3, the Control Bus 2 sends out a Start Command 21 to notify the multiple warning lights (11*a*~11*n*), set the Flash Mode 121 and sequentially number each warning light (11*a*~11*n*) by starting from 1, and use the Flash Mode 121 number to synchronously set the ID Number 122 of each warning light (11*a*~11*n*). Set the predetermined ID Number of these warning lights (11*a*~11*n*) to a Starter 4, and the rest of the ID Numbers to a Receiver 5. The warning light set to Starter 4 receives a Start Command 21 from the Control Bus 2, and sends a Data 31, a Clock Pulse 32 and an ID Information 33 from the Data Bus 3. Select one of them (Synchronous 1211, Interlace 1212, Polling 1213, Recursive 1214, Low Power 1215 or Standby 1216) by the Flash Mode 121 to flash the lights. The warning lights set to Receivers 5 receive the Data 31, the Clock Pulse 32 and the ID Information 33 through the Data Bus 3. The Receivers 5 and the Flash Mode 121 of the Starter 4 are flashing in sync, out of sync, Low Power 1215 or Standby 1216.

The above multiple warning lights (11*a*~11*n*) are synchronized to set the ID Number 122 of each warning light (11*a*~11*n*) through the Flash Mode 121 number. Generally speaking, the one that can set the ID Number to 1 is the Starter 4. But the present invention is not self-limiting. Each ID Number can be set as Starter 4 through the Control Bus 2. For example: the ID Number 2, 5, 8 and other numbers other than 1 may also be used as Starter 4. The mode of setting the warning light (11*a*~11*n*) of any ID Number through the Control Bus 2 as Starter 4 is also protected by the present invention.

When the Starter 4 and the Receivers 5 are synchronized or not synchronized, the lights are flashing, if they receive the ID Change Command 22 sent by their common Control Bus 2, then the ID of the Starter 4 and the plural Receivers 5 will be changed. The specific method is that before the Starter 4 and the Receivers 5 change their identities, the Receivers 5 suspend the current Flash Mode 121 and then execute a Self Flash Mode. The Control Bus 2 will re-send a Start Command 21 to notify the multiple warning lights (11*a*~11*n*), set the Flash Mode 121 and number each warning light (11*a*~1*n*) sequentially by starting from 1, and use the Flash Mode 121 number to synchronously set the ID Number 122 of each warning light (11*a*~11*n*).

Figure 4:
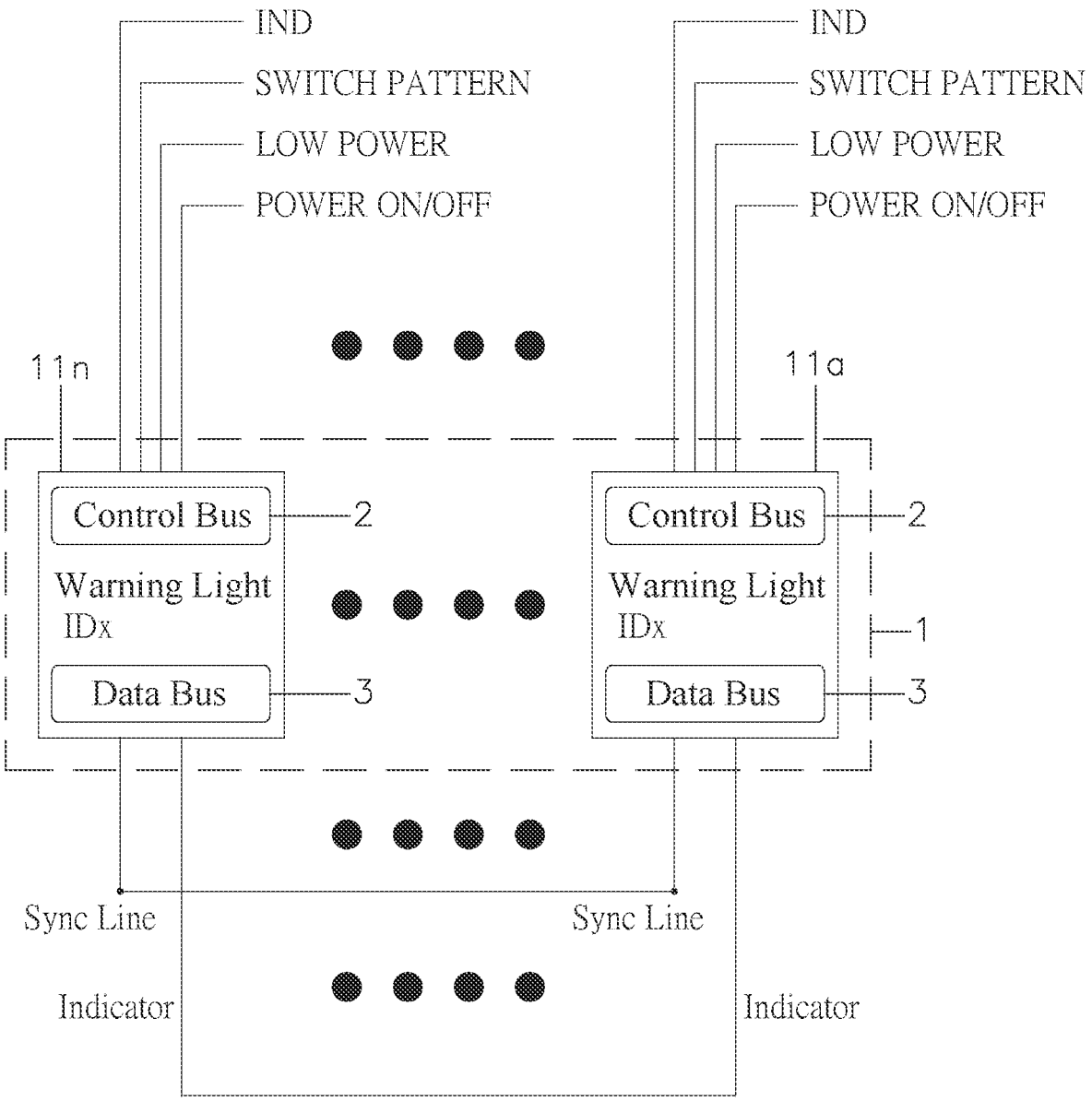
FIG. 4 is a schematic diagram of the connection of the light device and its circuit according to the present invention.
Figure 5:
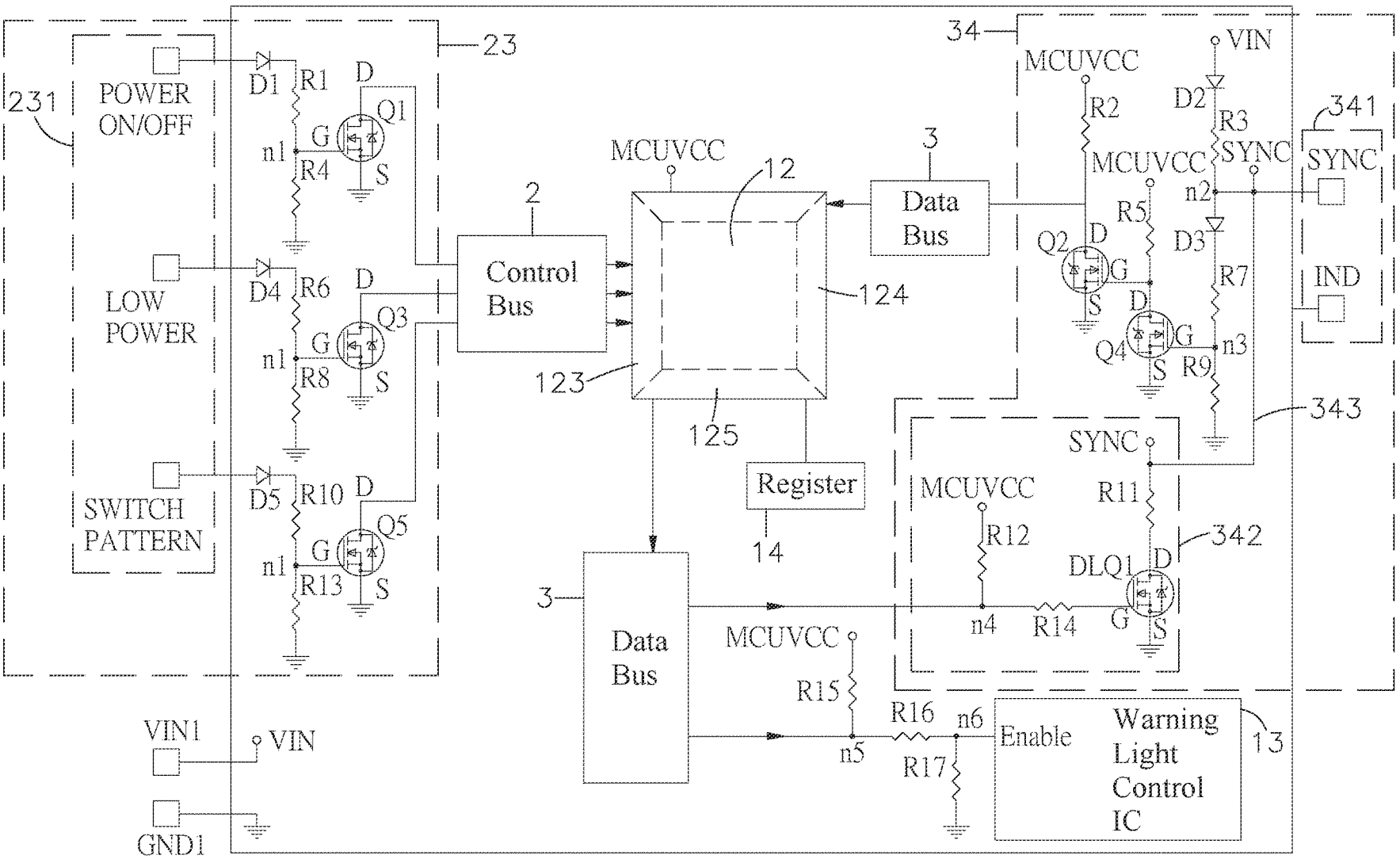
FIG. 5 is a circuit diagram of one single warning light of the present invention.

Please refer to FIGS. 3, 4, and 5, the signal processor 12 internally stores the data of a plurality of Flash Modes 121. Use the Flash Mode 121 number to simultaneously set the ID Number 122 of the warning lights (11*a*-11*n*), set the predetermined ID Number of the warning lights (11*a*~1*n*) as a Starter 4, and set the other ID Numbers as Receivers 5. A control circuit 23 comprises at least one control signal source 231, and the control signal source 231 is electrically connected to an active switch (Q1, Q3 or Q5). The output end of the active switch (Q1, Q3 or Q5) is electrically connected to a control input side 123 of the signal processor 12 through the Control Bus 2.

The data synchronization circuit 34 comprises at least one Data signal source 341. The Data signal source 341 is electrically connected to another active switch. The output end of the said another active switch is electrically connected to a data input side 124 of the signal processor 12 through the Data Bus 3. The signal processor 12 is electrically connected to a signal connection circuit 342 through a data output side 125 that is electrically connected to the Data Bus 3, thereby forming signal and command synchronization between the data input side 124 and the data output side 125.

The warning light control IC13 is connected to the warning lights (11*a*~11*n*) and forms an electrical connection with the Data Bus 3 outside the data output side 125, and transmits a Data 31, a Clock Pulse 32 and an ID Information 33 from the data output side 125. The Starter 4 and the Receivers 5 select one of the Flash Modes 121 to flash the lights.

The above-mentioned active switches (Q1, Q2, Q3, Q4, Q5, DLQ1) are composed of an N-Channel E-MOSFET. A Zener Diode, which can prevent electrostatic discharge (ESD), is connected between the source S and the drain D of the N-channel E-MOSFET.

A current limiter (D1, D3 or D5) and two resistors ([R1, R4], [R6, R8] or [R10, R13]) are connected in series between the control signal source 231 and the active switch (Q1, Q3 or Q5), and the floating terminals of the series connection of the two resistors ([R1, R4], [R6, R8] or [R10, R13]) are connected to a ground point. The first node n1 between the two resistors ([R1, R4], [R6, R8] or [R10, R13]) forms an electrical connection with the gate G of the active switch (Q1, Q3 or Q5). The source S of the active switch (Q1, Q3 or Q5) is connected to the ground point. The drain D of the active switch (Q1, Q3 or Q5) is connected to the control input side 123 of the signal processor 12. The current limiter (D1, D3 or D5) is composed of a diode.

The above-mentioned control signal source 231 includes a power switch signal (POWER ON OFF), a Low Power signal (LOW POWER), a switch mode signal (SWITCH PATTERN) and an instruction signal (IND).

There is a second node n2 between the above-mentioned Data signal source 341 and the other active switch set. The first side of the second node n2 is connected to an input voltage source VIN, a current limiter D2 and a resistor R3, and the second side of the second node n2 is connected in series with another current limiter D3 and another two resistors (R7, R9). The other active switch set is composed of a first stage active switch Q4 and a second stage active switch Q2. The floating terminals of the series connection of the said another two resistors (R7, R9) are connected to a ground point. The third node n3 between the two resistors (R7, R9) forms an electrical connection with the gate G of the second stage active switch Q2. The source S of the first stage active switch Q4 and the source S of the second stage active switch Q2 are connected to the ground point. The drain D of the second stage active switch Q2 is connected to the Data Bus 3 and the data input side 124 of the signal processor 12. The current limiter D2 and the other current limiter D3 are respectively composed of a diode.

The above-mentioned Data signal source 341 includes a synchronization signal (SYNC) and an instruction signal (IND).

The above-mentioned signal connection circuit 342 comprises a signal processor power supply MCUVCC and two resistors (R12, R14) connected in series. The floating terminal of the first resistor R12 is connected to the signal processor power supply MCUVCC. A fourth node n4 electrically connected to the Data Bus 3 outside the data output side 125 is formed between the first resistor R12 and the second resistor R14. The second resistor R14 is electrically connected to the gate G of an active switch DLQ1. The source S of the active switch DLQ1 is connected to the ground point. Another resistor R11 is connected in series with the drain D of the active switch, and the floating terminal of the other resistor R11 is electrically connected between the data signal source 341 and the other active switch set through a signal connection line 343.

Between the Data bus 3 outside the data output side 125 and the warning light control IC 13, a signal processor power supply MCUVCC and three resistors (R15, R16, R17) are connected in series in sequence. The floating terminal of the first resistor R15 is connected to the signal processor power supply MCUVCC. A fifth node n5 electrically connected to the Data Bus 3 is formed between the first resistor R15 and the second resistor R16. A sixth node n6 electrically connected to the enable pin Enable of the warning light control IC 13 is formed between the second resistor R16 and the third resistor R17. The floating terminal of the third resistor R17 is connected to a ground point.

The above-mentioned signal processor 12 is built-in or externally provided with a register 14 that can store the Data 31, the Clock Pulse 32 and the ID Information 33. The register 14 is composed of a non-volatile memory (NVM).

In the actual operation of the light device control circuit of the present invention, a plurality of warning lights (11*a*~11*n*) are made to accept a start command to set a Flash Mode 121. The start command refers to the complex control signals of power switch signal (POWER ON OFF), low power signal (LOW POWER), switch mode signal (SWITCH PATTERN) and instruction signal (IND) provided by the control signal source 231. The complex control signals make the gates G of the complex active switches (Q1, Q3, Q5) generate a forward conduction current. The output terminals of the complex active switches (Q1, Q3, Q5) transmit the complex control signals to the control input side 123 of the signal processor 12. After the signal processor 12 receives the control command, it uses the Flash Mode 121 stored in it to synchronously set the ID Numbers 122 of the plural warning lights (11*a*~11*n*), and set the predetermined ID Number of the plural warning lights (11*a*~11*n*) as a Starter 4, the other ID Numbers as Receivers 5.

After the warning light set as Starter 4 receives the complex control signals through the Control Bus 2, it transmits Data 31, Clock Pulse 32 and ID Information 33 through the Data Bus 3 outside the data output side 125, and choose one from the Flash Mode 121 (Synchronous 1211, Interlace 1212, Polling 1213, Recursive 1214, Low Power 1215 or Standby 1216) to flash the light. The warning lights set as Receivers 5 obtain Data 31, Clock Pulse 32 and ID Information 33 through the transmission of the Data Bus 3 and the warning light control IC 13, and the Flash Mode 121 of the multiple Receivers 5 and the Starter 4 are synchronized or not synchronized to flash the light. The Starter 4 sends Data 31, Clock Pulse 32 and ID Information 33 through the Data Bus 3 to control the multiple Receivers 5. Furthermore, the transmission and synchronization of instructions between the Starter 4 and the plurality of Receivers 5 need to rely on the connection between the signal connection circuit 342 and the signal connection line 343 to the Data signal source 341, and the synchronization signal (SYNC) and the instruction signal (IND) of the Data signal source 341 are connected to the Data Bus 3 and the data input side 124 of the signal processor 12 through the drain D of the second stage active switch Q2, so that the signals and commands between the data input side 124 and the data output side 125 are synchronized.

Please refer to FIGS. 3 and 5, the Control Bus 2 of the Starter 4 and the plurality of Receivers 5, after receiving the ID Change Command 22 sent by the switch mode signal (SWITCH PATTERN) of the control signal source 231, execute the changes of the Flash Mode 121, the ID Number 122, the Starter 4 and the multiple Receivers 5 to form the Flash Mode 121 change of the multiple warning lights (11*a*~11*n*).

The present invention mainly uses the control circuit structure shown in the above-mentioned FIGS. 1-5 to set each warning light to have its ID Number, and the Starter transmits data, clock and identity signals through the Data Bus to control the plurality of Receivers, which can improve warning light controls stability and flickering coordination. It has excellent practicability when applied to vehicles with Light Device (such as fire trucks, ambulances and police vehicles), so a patent application is filed to seek patent protection.

The above is only a preferred embodiment of the present invention, and it does not limit the patent scope of the present invention. Therefore, any simple modifications and equivalent structural changes made by using the contents of the description and drawings of the present invention should be similarly included in the patent scope of the present invention.

To sum up, the above-mentioned control circuit of the present invention applied to warning light can indeed achieve its effect and purpose when it is used. Therefore, the present invention is an invention with excellent practicability. In order to meet the application requirements for an invention patent, the application should be filed in accordance with the law. It is hoped that the review committee will approve the application as soon as possible to protect the inventor's hard work.

What the invention claimed is:

1. A light device control circuit, comprising:

a signal processor, said signal processor storing the data of a plurality of flash modes, using the numbers of said flash modes to set the ID Number of a plurality of warning lights synchronously, and setting a predetermined ID Number of said warning lights as a starter, and the other ID Numbers as receivers;

a control circuit comprising at least one control signal source, said at least one control signal source being electrically connected with an active switch, said active switch having an output end thereof electrically connected to a control input side of said signal processor through a control bus;

a data synchronization circuit comprising at least one data signal source, said at least one data signal source being electrically connected with another set of active switches, and the output end of said another set of active switches being electrically connected with a data input side of said signal processor through a data bus, said signal processor forming an electrical connection with a signal connection circuit by a data output side being electrically connected to said data bus, so as to form signal and command synchronization between said data input side and said data output side; and a warning light control IC connected to said warning lights and forming an electrical connection with said data bus outside said data output side, and transmitting a data, a clock pulse and an ID information from said data output side, so that said starter and said receivers select one of said flash modes to flash the light.

2. The light device control circuit as claimed in claim 1, wherein said active switches are composed of an N-Channel E-MOSFET, and said N-Channel E-MOSFET comprises a Zener diode connected between a source and a drain thereof to prevent electrostatic discharge.

3. The light device control circuit as claimed in claim 1, wherein a current limiter and two resistors are connected in series between said control signal source and each said active switch, plural floating terminals of the series connection of said two resistors being connected to a ground point, a first node between said two resistors forming an electrical connection with a gate of the associating said active switch, the source of the associating said active switch being connected to the ground point, the drain of the associating said active switch being connected to said control input side of said signal processor, said current limiter being composed of a diode.

4. The light device control circuit as claimed in claim 1, wherein a second node is formed between said data signal source and said another set of active switches, said second node having a first side thereof connected to an input voltage source, a current limiter and a resistor and a second side thereof connected in series with another current limiter and another two resistors, said another set of active switches being composed of a first stage active switch and a second stage active switch, the floating terminals of the series connection of said another two resistors being connected to a ground point, a third node being formed between said another two resistors to form an electrical connection with the gate of said second stage active switch, the source of said first stage active switch and the source of said second stage active switch being connected to said ground point, the drain of said second stage active switch being connected to said data bus and said data input side of said signal processor, said current limiter and the other said current limiter being respectively composed of a diode.

5. The light device control circuit as claimed in claim 1, wherein said signal connection circuit comprises a signal processor power supply and a first resistor and a second resistor connected in series, the floating terminal of said first resistor being connected to said signal processor power supply; a fourth node electrically connected to said data bus outside said data output side is formed between said first resistor and said second resistor, said second resistor being electrically connected to the gate of an active switch, which has the source thereof connected to a ground point and the drain thereof connected in series to the other resistor, the floating terminal of the other said resistor being electrically connected between said data signal source and said another set of active switches through a synchronization connection line.

6. The light device control circuit as claimed in claim 1, wherein between said data bus outside said data output side and said warning light control IC, a signal processor power supply and first, second and third resistors are connected in series in sequence, the floating terminal of the first resistor being connected to said signal processor power supply, a fifth node electrically connected to said data bus being formed between the first resistor and the second resistor, a sixth node electrically connected to an enable pin of said warning light control IC being formed between the second resistor and the third resistor, the floating terminal of the third resistor being connected to a ground point.

7. The light device control circuit as claimed in claim 1, wherein said signal processor is built-in or externally provided with a register to store said data, said clock pulse and said ID information, said register being composed of a non-volatile memory.

8. The light device control circuit as claimed in claim 1, wherein said control signal source comprises a power switch signal (POWER ON OFF), a low power signal (Low Power), a switch mode signal (SWITCH PATTERN) and an instruction signal (IND).

9. The light device control circuit as claimed in claim 1, wherein said data signal source comprises a synchronization signal (SYNC) and an instruction signal (IND).

10. The light device control circuit as claimed in claim 1, wherein said signal processor is composed of a microcontroller or a central processing unit.

* * * * *